United States Patent [19]

Takami et al.

[11] 4,377,265

[45] Mar. 22, 1983

[54] FLYING OBJECT

[75] Inventors: Toshiji Takami; Toshio Ito; Fusako Kawaguchi, all of Amagasaki, Japan

[73] Assignee: Mitsubishi Denki Kabushiki Kaisha, Japan

[21] Appl. No.: 213,057

[22] Filed: Dec. 4, 1980

Related U.S. Application Data

[63] Continuation of Ser. No. 731,109, Oct. 8, 1976, abandoned.

[30] Foreign Application Priority Data

Oct. 16, 1975 [JP] Japan ..... 50-124806

[51] Int. Cl.[3] ..... B64C 31/06

[52] U.S. Cl. ..... 244/153 R

[58] Field of Search ..... 244/153 R, 154, 155 R; D21/88, 89

[56] References Cited

U.S. PATENT DOCUMENTS 743,301 11/1903 Lischtiak ..... 244/153 R 1,029,010 6/1912 Guillo ..... 244/153 R

*Primary Examiner*—Galen L. Barefoot

*Attorney, Agent, or Firm*—Robert E. Burns; Emmanuel J. Lobato; Bruce L. Adams

[57] ABSTRACT

The disclosed kite comprises two right-angled triangular frameworks symmetric with respect to a common side which forms a right angle with another side of each triangle. The triangular frames are pivotably interconnected through that common side, and a bilateral symmetric wind-bearing surface is carried by the frameworks. An arcuate resilient member connects the free ends of the other sides of the triangles to each other and has a spring constant greater than five times the weight of the kite divided by a distance between a point of attachment of a line to the kite and a point of attachment of the resilient member to one of the triangular frameworks and less than one half a tensile strength of the line attached to the kite.

2 Claims, 12 Drawing Figures

FIG. 5A
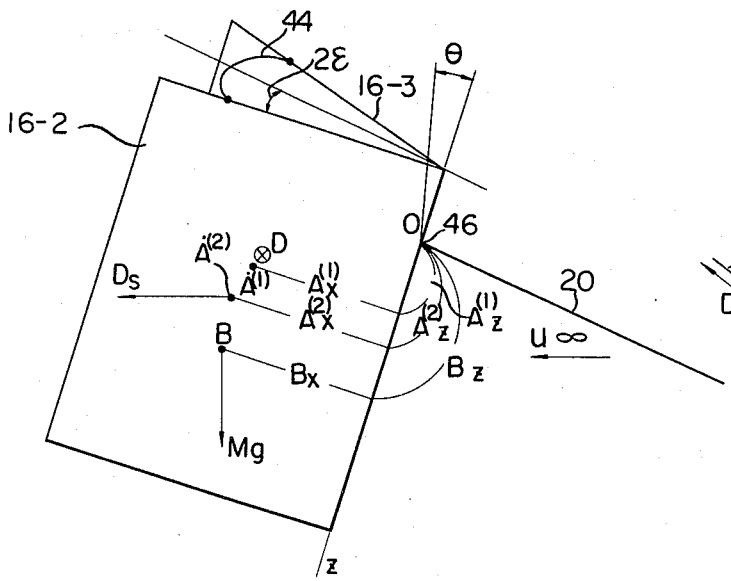
FIG. 5B
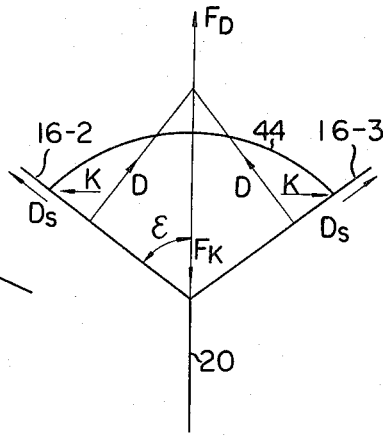
FIG. 6A
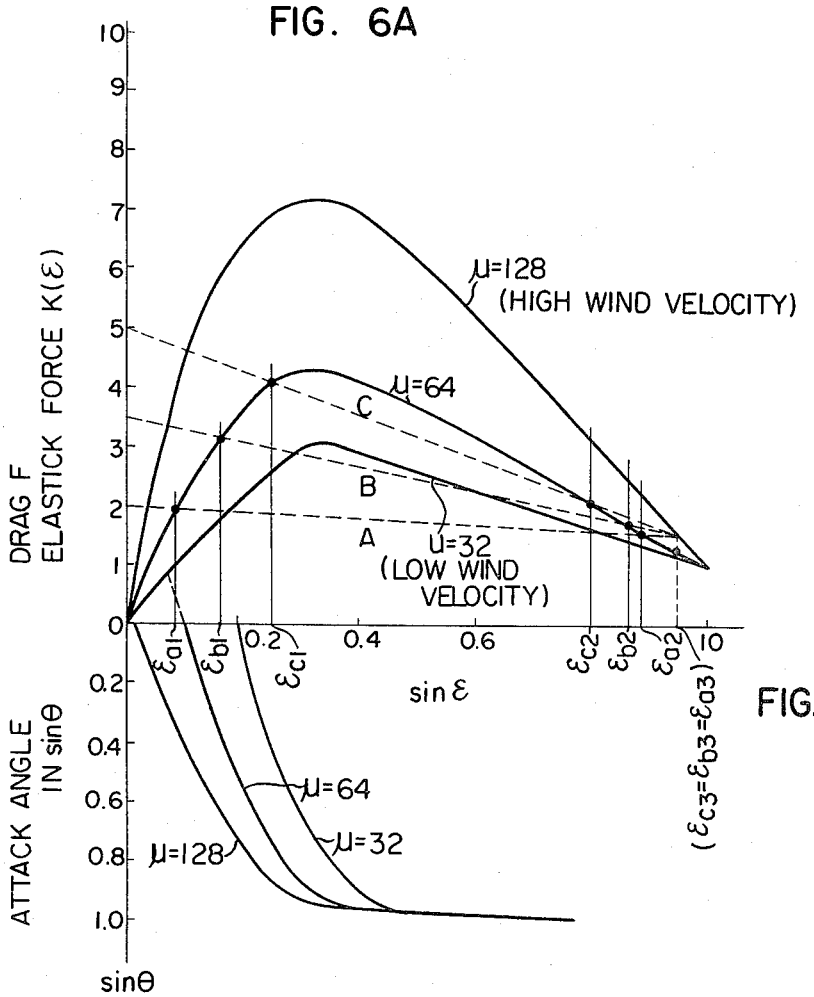
FIG. 6B

FLYING OBJECT

This is a continuation of application Ser. No. 731,109, filed Oct. 8, 1976 and now abandoned.

BACKGROUND OF THE INVENTION

This invention relates to improvements in a flying object supported by a piece of string to fly in the air with the wind. That is, it relates to the so-called flying kites.

The bilateral symmetric plain surfaces of conventional kites could respond to the wind to be deformed unsymmetrically with respect to their symmetry axis due to frame members involved having different flexibilities. For a relatively strong wind the kites could be rotated until they falled to the ground. Also in three-dimensional kites of the conventional construction, it has been required to increase the strength of frame members involved because the bilateral wind-bearing surfaces undergo a wind to the end. Thus the kites have extremely increased in weight. As a result, such kites have not been raised in the air unless the particular wind is fairly strong and it has been required to use the strong, heavy string therewith because of an increase in wind pressure applied thereto.

Accordingly it is an object of the present invention to provide a new and improved flying object or kite extremely stably flying in the air in spite of a strength of the particular wind.

It is another object of the present invention to determine a spring constant of a resilient member incorporated into the flying object of the type as described in the preceding paragraph.

SUMMARY OF THE INVENTION

The present invention provides a flying object comprising at least two plain surfaces formed to bear a wind and respond to a wind pressure caused by the wind to change a relative position of one to the other of the plain surfaces, a resilient member or spacer for interconnecting the plain surfaces and a string-shaped member or line for restraining the plain surfaces while the object is flying in the air with the wind, wherein the resilient member has a spring constant having a value greater than five times the weight of the flying object divided by a distance between a point of attachment of the line to the kite and a point of attachment of the resilient spacer to one of the plain surfaces.

The two plain surfaces may be preferably formed a plurality of frame members disposed symmetrically with respect to the central axis of the object to be movably interconnected on the central axis and a wind bearing surface member disposed in tensioned state on the frame members.

The frame member advantageously form a pair of triangular frameworks having a common side on the central axis and symmetric with respect to the common side.

BRIEF DESCRIPTION OF THE DRAWING

The present invention will become more readily apparent from the following detailed description taken in conjunction with the accompanying drawings in which:

FIG. 5A is a perspective view of a model made for the arrangement shown in FIG. 4;

FIG. 5B is a side elevational view of the arrangement shown in FIG. 5A;

FIG. 6 is characteristic curves resulting from a mathematical analysis conducted with the arrangement shown in FIGS. 5A and 5B wherein FIG. 6A shows the relationship between the resultant forces due to a wind pressure and a resilience provided by the resilient member shown in FIGS. 5A and 5B and an interfacial angle formed between the wind bearing surfaces with a wind velocity taken as the parameter; FIG. 6B shows an attack angle of the model as a function of the interfacial angle.

DESCRIPTION OF THE PREFERRED EMBODIMENTS

Figure 1:
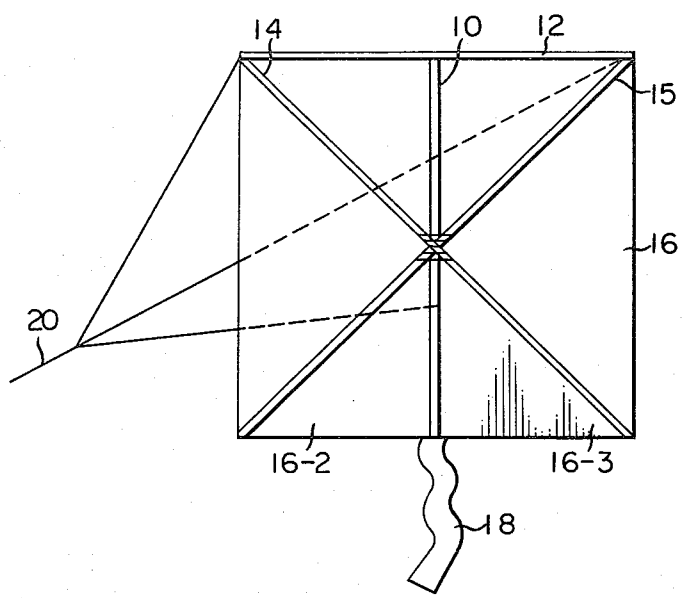
FIG. 1 PRIOR ART
FIG. 1 is a plan view of a kite most popular in Japan.

Referring now to the drawings and FIG. 1 in particular, there is illustrated a kite well known in Japan. The arrangement illustrated comprises a framework including a spinal frame member 10, a rib frame member 12 connected at the middle point to the spinal member 10 at one end, in this case the upper end as viewed in FIG. 1 to extend perpendicularly to the spinal member, and a pair of stay frame members 14 and 15 disposed in an X shape and having their intersection suitably tied to the spinal member 10 at the middle point. The upper ends as viewed in FIG. 1 of the stay frame members 14 and 15 are suitably connected to both ends of the rib frame member 12 respectively. All the frame members are formed by whittling bamboo (*Phyllostachys mitis*) or the like into slender rods.

Then a rectangular piece of a suitable surface member 16 such as Japanese paper or cloth is bonded on those frame members by means of a suitable paste to form a pair of plain surfaces 16-2 and 16-3 bilaterally symmetric with respect to the axis of the spinal frame member 10. A tail 18 formed preferably of the same material as the surface material 16 is attached to the other or lower end of the spinal frame member 10 to impart the stability to the kite thus produced.

As shown in FIG. 1, three pieces of string 20 are connected at one end to both ends of the rib member 12 and a suitable point on the spinal member 10 respectively and at the other ends to a single piece of string.

It is well known that, as a wind becomes strong to a certain extend, the plain surfaces 16-2 and 16-3 are deformed due to the flexibility of the frame members 12, 14 and 15 or the frame member 10. In this case, if the frame members 12, 14 and 15 are completely uniform in flexibility then the bilateral plane surfaces are deformed symmetrically with respect to the axis of the spinal member 10 providing a symmetry axis and the kite is permitted to stably fly in the air without the occurrence of a rotational force due to the wind. However the material of the frame members are generally different in flexibility from one another and therefore the bilateral plain surfaces may be deformed unsymmetrically with respect to the symmetry axis formed of the spinal frame member 10. In an extreme case, a relatively strong wind may rotate such a kite until the latter will fall to the ground.

In order to diminish the rotation of the kite as much as possible, the tail 18 has been attached to the lower portion of the kite. The attachment of the tail does not necessarily result in the kite being completely prevented from rotating and rather gives the disadvantage that the kite becomes difficult to fly in the air because the weight of the tail increases the overall weight of the kite.

Figure 2:
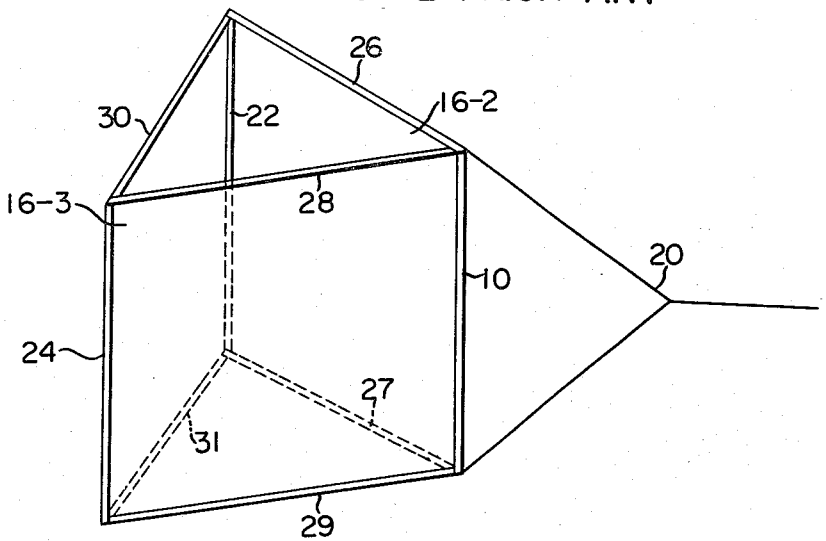
FIG. 2 PRIOR ART
FIG. 2 is a perspective view of a three-dimensional kite of the conventional construction.

A conventional kite shown in FIG. 2 is of a three-dimensional type and comprises a framework in the form of a triangular prism including a spinal frame member 10 and a pair of auxiliary spinal frame members 22 and 24 disposed in parallel relationship and in such a manner that the upper and lower ends thereof form vertices of identical isosceles or regular triangles. The upper and lower ends of those frame members 10, 22 and 24 are interconnected through rib frame members 26, 28, 30 and 27, 29, 31 extending perpendicularly to the spinal members 10, 22 and 24. Then a pair of plain surfaces portions 16-2 and 16-3 are formed by bonding a corresponding pieces of paper or the like on the frame members 26, 10, 27 and 22 and the frame members 28, 10, 29 and 31 by a suitable paste respectively. The three-dimensional kite is completed by attaching furcate ends of a piece of string 20 to both ends of the spinal frame member 10.

The arrangement of FIG. 2 has the plain surfaces 16-2 and 16-3 less deformed due to the wind and provides a kite capable of stably flying in the air without the rotation thereof due to the wind. However since such a kite bears a wind pressure to the end resulting in the necessity of increasing the strength of the frame members. As a result, the kite extremely increases in weight. This leads to the disadvantages that the kite is not flying in the air unless the particular wind is fairly strong and that it is required to use a special string that is strong and heavy because a high wind pressure is applied to the kite.

Figure 3:
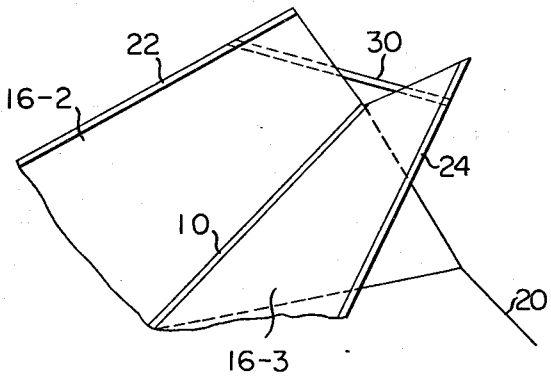
FIG. 3 PRIOR ART
FIG. 3 is a fragmental perspective view of another conventional kite.

FIG. 3 shows another conventional kite of the three-dimensional type. The arrangement illustrated is different from that shown in FIG. 2 only in that in FIG. 3 the auxiliary spinal frame members 22 and 24 are tilted at relatively small angles to the spinal frame member 10 and interconnected through the rib member 30 connected at both ends to those portions thereof adjacent to the upper ends with all the remaining rib members omitted. The plain surfaces 16-2 and 16-3 are formed of polyvinyl chloride sheet bonded to the associaed frame members.

In the arrangement of FIG. 3 the number of the frame members is small as compared with that shown in FIG. 2 resulting in a light kite having the good flight performance. Also when the polyvinyl chloride sheet forming the plain surface is high in strength, the kite can continue to stably fly in the air as does the three-dimensional kite shown in FIG. 2. However, regarding the disadvantage of three-dimensional kites that they receive the wind pressure to the end, the arrangement as shown in FIG. 3 has not yet been improved. Therefore upon the arrangement of FIG. 3 undergoing a strong wind, the piece of polyvinyl chloride sheet bonded to the frame members could be stripped from the frame members at their junctions resulting in the damage. Also it has been disadvantageous in that a special high strength string is required as in the arrangement of FIG. 2. Further an angle formed between the frame member 22 or 24 and the frame member 10 has been limited to an acute angle that is fairly smaller than a right angle which is the great disadvantage of the arrangement shown in FIG. 3. As a result, such kites should be designed within a limited range.

The present invention substantially eliminates the disadvantages of the prior art practice as above described by the provision of a flying object having a novel unique structure including at least two plain surfaces designed and constructed to be relatively movable.

Figure 4:
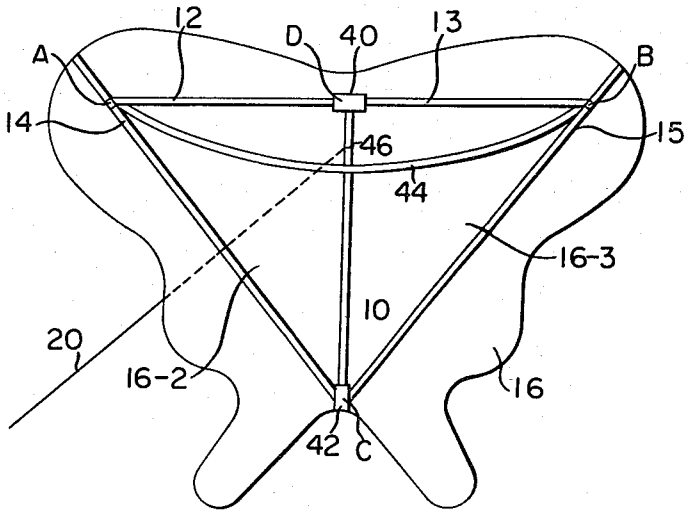
FIG. 4 is a plan view of a flying object or a kite constructed in accordance with the principles of the present invention.

Referring now to FIG. 4, there is illustrated a flying object constructed in accordance with the principles of the present invention. The flying object may be called hereinafter a kite for convenience sake. The arrangement illustrated comprises a spinal member 10, a pair of rib members 12 and 13 articulated to each other by a hinge 40 to be aligned with and perpendicular to spinal member 10 to each other, and a pair of stay members 14 and 15 having lower ends connected together by means of a hinge 42 to be tilted at equal angles to the spinal member 10 and upper end portions rigidly connected to the free ends A and B of the rib members 12 and 13 respectively. The spinal member 10 has both ends connected to the hinges 40 and 42 respectively. Thus the stay members 14 and 15 are articulated at lower ends to the spinal member 10 at the lower end. Also an arcuated resilient member 44 is span between the junction A of the lefthand members 12 and 14 and the junction B of the righthand members 13 and 15.

Then a bilateral symmetric piece 16 of surfaces material such as paper or polyvinyl chloride sheet is bonded to a framework including the members as above described by means of any suitable bonding agent while a piece of string 16 is tied to a supporting point 46 on spinal member 10.

The framework forms a pair of right-angled triangles ACD and BDC identical to each other and bilaterally symmetric with respect to the axis of the spinal member 10 with the side DC common to both triangles. Both triangles have respective verticles A and B connected through the resilient member 44.

The piece 16 of surface material bonded on the framework forms a pair of plain surfaces or wing 16-2 and 16-3 providing wind bearing surfaces articulated to each other along and bilaterally symmetric with respect to the axis of the spinal member 10. While the piece 10 is shown in FIG. 4 as having a profile resembling that of a butterfly flitting as viewed in plan, it is to be understood that the piece may have any desired profile that is bilaterally symmetric with the central axis thereof.

Therefor the wings 16-2 and 16-3 are movable toward and away from each other about the axis of the spinal member 10 and under the control of the resilient member 44 to permit the arrangement of FIG. 4 to be stably flying in the air in a wide range of wind velocities. It has been found that the resilient member 44 has a resilience or a spring constant much affecting the flight performance of the kite. By properly selecting the spring constant of the resilient member 44, the kite can fly with a flap of wings just as a living being such as a butterfly or a bird. This is very attractive.

The present invention is particularly concerned with such a resilient member. The invention will now be described in conjunction with FIG. 5 wherein a model made for the arrangement of FIG. 4 is shown as including a supporting point connected to a piece of string and a pair of plain surfaces or wings substantially symmetric with respect to a straight line passing through the supporting point. Also symbols or parameters used herein are defined as follows.

S: area of plain surface or wing area $U_\infty$: wind velocity assuming that it only includes a component parallel to the surface of the earth M: mass of modeled kite $\rho$: mass of air $A^{(1)}$: vector connecting supporting point to center of wind on first plain surface or wing $A^{(2)}$: vector connecting supporting point to center of wind on second plain surface or wing B: vector connecting supporting point to center of gravity.

It is noted that any vector is represented by its own symbol having a dot at the top thereof.

FIG. 5A is a perspective view of the modeled kite for the kite shown in FIG. 4 and FIG. 5B is a side elevational view thereof. FIG. 5A also shows a three-dimensional orthogonal coordinate system including the origin O lying at the supporting point 46 having the piece of string 20 or a kite string tied thereto, an x axis bisecting an interfacial angle $2\epsilon$ formed between the pair of the plain surfaces or wings 16-2 and 16-3 and a z axis lying on the central axis along which those wings intersect each other and directed downwardly as viewed in FIG. 5A. Referring to this coordinate system, a wind pressure and a lift applied to and an attack angle $\theta$ of a modeled kite such as shown in FIGS. 5A and 5B will now be discussed by using the symbols or parameters as above described.

Since it is considered that in a space where a wind velocity $U_\infty$ exists, torques exerted on the flying object are a torque due to a wind pressure and a torque due to the gravity, each torque will be described.

Regarding a wind pressure applied perpendicularly to each plain surface or wing of the modeled kite, a pressure drag per unit area can be approximately expressed $$D=(C_D/2)\rho U^2_\infty S \cos \alpha$$

where $C_D$ designate a drag coefficient and $\alpha$ designates an angle between a direction orthogonal to a wing surface and a stream line of a wind velocity $U_\infty$. From FIGS. 5A and 5B, the following equation is obtained:

$$\cos \alpha=\cos \theta \sin \epsilon$$

where $\theta$ designates an attack angle of the modeled kite to a wind and $\epsilon$ designates one half an interfacial angle formed between the two wings 16-2 and 16-3. The $\theta$ and $2\epsilon$ are shown in FIG. 5A. From the above two equations there is obtained $$D=(C_D/2)\rho U^2_\infty S \cos \theta \sin \epsilon \quad (1)$$

Detailed information can be found in S. F. Hoerner book entitled "Fluid-Dynamic Drag", 1965, pp 3–16. The pertinent pages of the cited book is incorporated herein by reference.

In the flying object of the present invention the drag D expressed by the equation (1) is applied to each of the wings and the resultant of both wind pressures forms a lift with which the flying object flys up in the air. Assuming that $F_D$ designates the resultant of the wind pressures, it can be seen in FIG. 5B that $$F_D=\Sigma D \sin \epsilon$$

is held. Substituting this into the equation (1) gives $$F_D=2(C_D/2)\rho U^2_\infty S \cos \theta \sin^2\epsilon$$

By putting $D_o=(C_{D'}/2)\rho U^2_\infty S$ in the above equation, the $F_D$ is reduced to $$F_D=D_o \cos \theta \sin^2\epsilon \quad (2)$$

As seen in FIG. 5A, the force $F_D$ has its torque $T_D$ about the origin or the supporting point 46 expressed by $$T_D=A_z^{(1)}D_o \cos \theta \sin^2\epsilon$$

where $A_z^{(1)}$ designates a component along the Z axis of the vector $A^{(1)}$.

It is assumed that the wind velocity $U_\infty$ is parallel to the surface of the earth as above described and as shown by the arrow in FIG. 5A and that Ds designates a skin friction drag caused from that component of the wind velocity running along each wing as shown in FIGS. 5A and 5B. Then Ds is approximately expressed by $$D_s=(C_{D'}/2)\rho U^2_\infty S \cos \epsilon$$

where $C_{D'}$ designate a skin friction drag coefficient. Since the skin friction drags are equally applied to the two wings, the resultant Fs of these drags or forces applied to the wings is expressed by $$Fs = \Sigma Ds \cos\epsilon = 2\frac{C_D}{2}\rho\, U^2_\infty\, S \cos^2\epsilon$$

which is reduced to $$Fs=D'o \cos^2\epsilon \quad (3)$$

by putting $D'o=2(C_{D'}/2)\rho U^2_\infty S$ as in the pressure drag. As seen in FIG. 5A, the resultant Fs has its torque Ts about the supporting point 46 expressed by $$Ts=A_z^{(2)}D'o \cos^2\epsilon \cos \theta=A_x^{(2)}D'o \cos^2\epsilon \sin \theta \cos \epsilon$$

where $A_x^{(2)}$and $A_z^{(2)}$ are the x and z components of the vector $A^{(2)}$. It is assumed that a torque about the supporting point directed in the clockwise direction is positive.

Further, the weight of the flying object per se causes a gravity torque about the supporting point. As seen in FIG. 5A, the weight expressed by Mg causes a torque $T_M$ about the supporting point 46 expressed by $$T_M=B_zM_g \sin \theta+B_xM_g \cos \theta \cos \epsilon$$

where $B_x$ and $B_Z$ are the x and z components of the vector B for the center of gravity of the modeled kite.

From the foregoing it will readily be understood that, in order to maintain the kite stationary in the air, that the algebraic sum of the torques of wind pressure should be equal to the gravity torque about the supporting point on the assumption that the kite string has a negligibly small weight. That is, one obtains $$A_z^{(1)} Do \cos\theta \sin^2\epsilon + A_z^{(2)} Do' \cos^2\epsilon \cos\theta - A_x^{(2)} D'o \cos^2\epsilon \sin\theta \cos\epsilon - B_z M_g \sin\theta - B_x M_g \cos\theta \cos\epsilon = 0$$

This equation can be rearranged to $$\tan\theta = (A_z^{(1)} Do \sin^2\epsilon + A_z^{(2)} D'o \cos^2\epsilon - B_x M_g \cos\epsilon)/(B_z M_g + A_x^{(2)} D'o \cos^3\epsilon) \quad (4)$$

This equation depicts the relationship between the wind velocity $U_\infty$ and the attack angle $\theta$.

Then a lift for the kite of FIG. 5A will now be described. From FIG. 5A it can be seen that the pressure drags applied to the wings and the weight of the kite per se are pertinent to the lift thereof. The pressure drag $F_D$ applied to the wings has its component $F_D \sin\theta$ contributing to the lift as seen in FIG. 5A. This lift designated by $F_u$ is expressed by $$F_u = F_D \sin\theta = Do \cos\theta \sin^2\epsilon \sin\theta = Do \sin^2\epsilon \frac{\sin 2\theta}{2} \quad (5)$$

The condition for flying the kite in the air fulfills the relationship $F_{uD} > M_g$. In other words, the following relationship must be held:

$$Do \frac{\sin 2\theta \sin^2\epsilon}{2} > M_g$$

Assuming that $\mu$ satisfies $\mu = A_z^{(1)} Do / B_z M_g$, the above relationship is rearranged to $$\mu \frac{\sin 2\theta \sin^2\epsilon}{2} > \frac{A_z^{(1)}}{B_z}$$

Since the $\mu$ is a factor concerning the weight of the kite, the area of the wing and wind velocity, the above equation describes the relationship between a wind velocity and a lift for a given flying object or a given kite.

Figure 6C:
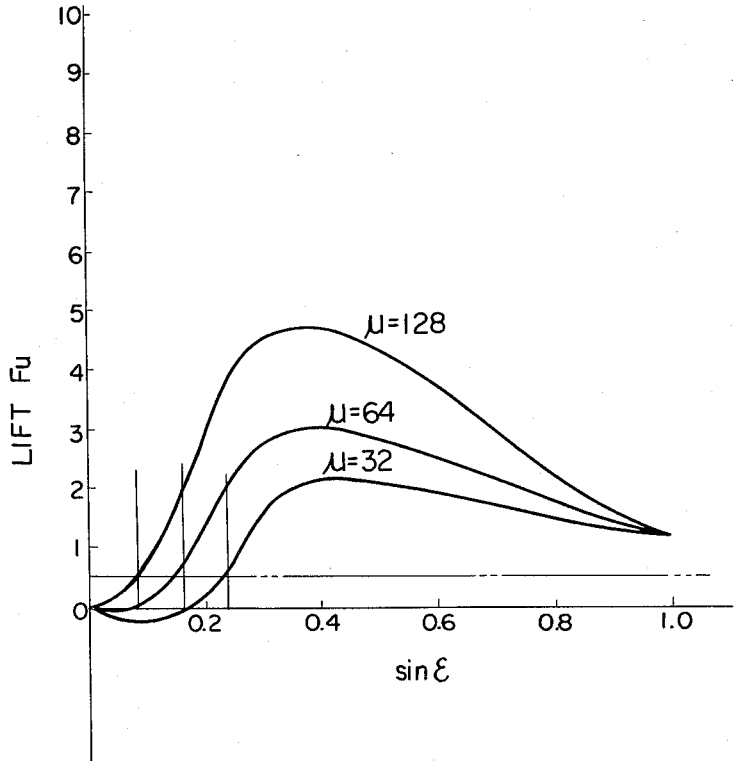
FIG. 6C shows a lift applied to the model as a function of the interfacial angle.

The results of the discussion as above described are shown in FIGS. 6A, 6B and 6C, in those Figures the wind velocity is used as the parameter. That is, $\lambda = A_z^{(1)} Do / B_z M_g$ has values differently given. In FIG. 6A the force F due to the wind pressure is plotted in ordinate as a function of sin $\epsilon$ in abscissa and in FIG. 6B the attack angle represented by sin $\theta$ is plotted in ordinate as a function of sin $\epsilon$ in abscissa. In FIG. 6C, the lift Fu is similarly plotted as a function of sin $\epsilon$ with a required minimum lift designated horizontal broken line. In FIG. 6A the force F due to the pressure drag is equal to the sum of the $F_D$ and $F_S$ expressed by the equations (2) and (3). FIG. 6B shows the equation (4), and the lift $F_u$ in FIG. 6C is expressed by the equations (5). FIG. 6A also shows an elastic force $K(\epsilon)$ exerted by a resilient member such as the resilient member 44 (see FIGS. 4 and 5) as a function of sin $\epsilon$ at broken line. It is assumed that $K(\epsilon)$ is expressed by $K(\epsilon) = \lambda b(1 - \sin\epsilon)$ where $\lambda$ designates a spring constant of the resilient member 44 and b designates a distance between the supporting point 46 and the junction A or B of the resilient member 44 and the frame member 14 or 15 as shown in FIG. 4.

In flying objects such as shown in FIG. 4 or 5 the resilient member coupling the pair of plain surfaces or wings to each other may be selected at will but the present invention particularly contemplates to determine a spring constant thereof in order to stably fly an associated kite in the air within a wide range of wind velocities. To this end, it is supposed that three resilient members A, B and C have different spring constants described by dotted curves (A), (B) and (C) shown in FIG. 6A respectively as expressing $Ki(\epsilon) = b\lambda_i(1 - \sin\epsilon)$ where i=A, B, C. $K_A$, $K_B$ and $K_C$ designate elastic forces exerted by the resilient members A, B and C respectively, and $\lambda_A$, $\lambda_B$ and $\lambda_C$ designate spring constants of the members A, B and C respectively.

Figure 7:
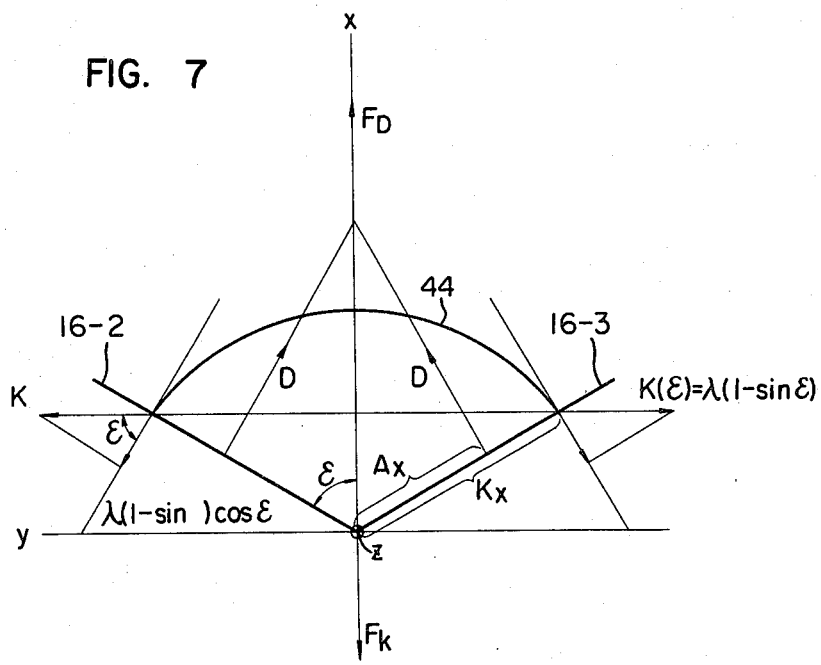
FIG. 7 is a view similar to FIG. 5B and useful in explaining the resultant forces due to the wind pressure and resilience and a tension of a kite string.

The resilient member A, B or C is coupled to the two plain surfaces or wings as above described to form an interfacial angle $2\epsilon$ therebetween which is, in turn, definitely determined by both a resilience provided by the resilient member and the resultant force due to the wind pressure applied to both wings. The relationship between the resilience and that force is shown in FIG. 7. In FIG. 7 the aforesaid resultant F of forces due to the wind pressure exerted on both wings 16-2 and 16-3 respectively is shown in FIG. 7 as lying on the x axis and pointing away from the z axis while the result and $F_K$ of resiliences exerted on both wings, from the resilient member 44 at both ends respectively is shown as lying on the x axis and opposite in sense to the resultant of forces $F_D$. More specifically, assuming that the resilient member 44 has its resilience $K(\epsilon)$ expressed by $K(\epsilon) = b\lambda(1 - \sin\epsilon)$ as previously described and having a line of action parallel to the y axis as shown in FIG. 7. That component of the resilience orthogonal to the associated wing 16-2 or 16-3 is expressed by $b\lambda(1 - \sin\epsilon) \cos\epsilon$. Therefore a resilience $F_k$ exerted on both wings or the resultant of such components is given by $$F_k = 2\lambda b(1 - \sin\epsilon) \cos\epsilon \sin\epsilon.$$

With both resultants F and $F_K$ equal in magnitude to each other, the flying object is stabilized with a corresponding interfacial angle $2\epsilon$ formed between both wings thereof.

Referring back to FIG. 6A, the resilient member A will now be described with $\mu = 64$ corresponding to a wind velocity of about 6 meters per second. From FIG. 6A it is seen that the wind pressure balances the resilience at each of three points $\epsilon$a1, $\epsilon$a2 and $\epsilon$a3 on the axis of abscissas. Among those three points, the point $\epsilon$a3 brings the flying object into its stable state with winds relative gentle. However as the particular wind becomes high, the flying object goes to its other stable state designated by $\epsilon$a1 following broken line (A). From FIG. 6A it is presumed that the intermediate point $\epsilon$a2 brings the flying object into its unstable state.

At the stable point $\epsilon$a1 the flying object has a negative attack angle as seen in FIG. 6B (wherein the attack angle is represented by sin $\theta$) and also a negative lift as seen in FIG. 6C. Therefore it will be appreciated that, with the resilient member A used, an increase in wind velocity results in the instability of the flying object and therefore its fall.

With the resilient member C used, the resilience curve (C) similarly intersects the wind pressure curve labelled $\mu = 64$ at three points having abscissas $\epsilon$c1, $\epsilon$c2 and $\epsilon$c3. At each of those three points, an associated flying object has a wind pressure and a resilience exerted thereon to balance each other. From FIGS. 6B and 6C it is seen, that an attack angle and a lift at the point $\epsilon c1$ have respective values sufficient to stabilize the flying object in the air as at the point $\epsilon a1$. However it is to be noted that the force F due to the wind pressure has a very large value at the point $\epsilon c1$ as seen in FIG. 6A. This means that structural members forming the flying object and a kite string are required to be fairly high in strength.

With the resilient member B incorporated into a flying object, an attack angle and a lift at a stable point having an abscissa $\epsilon b1$ are of small values as compared with the resilient member C but have respective values sufficient to flutter the flying object in the air. In this case, it is noted that the force due to a wind pressure becomes small as shown in FIG. 6A.

From the foregoing it can be concluded that among the three resilient members A, B and C as above exemplified, the resilience provided by the resilient member B is of a minimum value required for flying objects such as shown in FIG. 4 to be maintained to stably fly in the air.

Accordingly it is summarized that upon selecting a resilient member for use in a flying object in accordance with the principles of the present invention, the resilient member is required to have a resilience providing stable points (whose abscissas are $\epsilon_1$ and $\epsilon_2$ respectively) on a curve for a force due a wind pressure exerted on the flying object so as to prevent the flying object from being deprived of its lift at every wind velocity.

Subsequently the description will be described in terms of the relationship between a tensile strength of a kite string and the resilience as above described. As seen in FIG. 7 the flying object has applied thereto a tensile strength as determined by the total force F due to the wind pressure exerted thereon. On the other hand, the kite string has a tensile strength $F_T$ equal in magnitude and opposite in sense to the total force F due to the wind pressure. Also as above described, the force F is equal in magnitude and opposite in sense to the resilience $F_K$ under the stable state of the flying object which is satisfied at every point. Therefore the tensile strength $F_T$ of the kite string is equal in both magnitude and sense to the resilience $F_K$. This means that the tensile strength of the kite string is definitely determined by the resilience provided by the resilient member independently of the wind pressure acting on the flying object.

On the other hand, it is known that a string such as the kite string has a strength $F_{ST}$ proportional to its weight per unit length.

Figure 8:
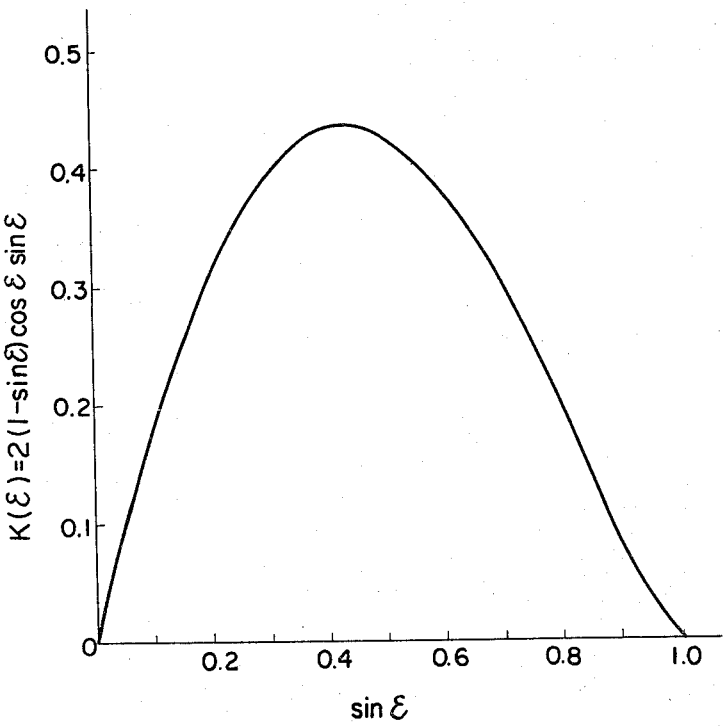
FIG. 8 is a graph illustrating the relationship between the resilience of the resilient member shown in FIGS. 5A and 5B and the interfacial angle, assuming that the resilience is a function of the interfacial angle.

That is, $F_{ST}=\beta\rho_s$ is obtained where $\beta$ designates a proportional constant and $\rho_s$ designates a mass per unit length of a sting. In order to prevent the kite string from cutting, the strength $F_{ST}$ must be greater than the resilience $F_K$ applied to both wings. That is, $$F_{ST}>2\lambda b(1-\sin\epsilon)\cos\epsilon\sin\epsilon$$

or $$(F_{ST}/b\lambda)>2(1-\sin\epsilon)\cos\epsilon\sin\epsilon$$

is given. FIG. 8 shows the strength $F_{ST}$ divided by $\lambda$ or $2(1-\sin\epsilon)\cos\epsilon\sin\epsilon$ plotted as a function of $\sin\epsilon$. FIG. 8 depicts that a kite string is not cut as far as its strength is greater than one half the spring constant $\lambda$ of the particular resilient member.

Therefore it is summarized that, after the type of kite string has been determined to be used in the flying object of the present invention, that a resilient member used with the present invention should have a spring constant fulfilling the inequality for the $F_{ST}$ as above described.

Figure 9:
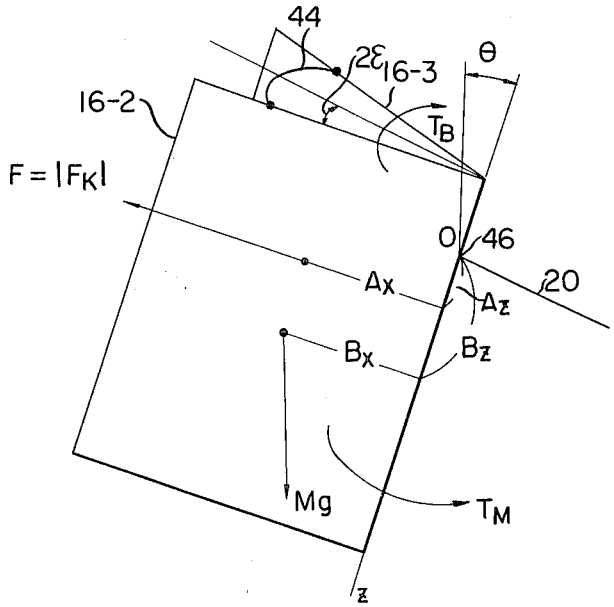
FIG. 9 is a view similar to FIG. 5A and useful in explaining torques exerted on the model shown in FIGS. 5A and 5B about a supporting point thereof.

Finally the relationship between the resilience provided by the resilient member and the weight of the flying object will be discussed. With the flying object maintained stationary in the air, it is considered that forces as shown in FIG. 9 are exerted on the flying object and in an equilibrium. FIG. 9 illustrates the modeled kite of FIG. 5A on which the resultant force F due to the wind pressure and the gravity or weight $M_g$ of the modeled kite are exerted along the x axis at the center of wind for both wings and in the vertical direction and the center of gravity respectively.

Under these circumstances if the flying object or the modeled kite slightly changes in attack angle $\theta$ under the influence of a variation in direction of the wind for example then the modeled kite tends to be returned back to its original state through its righting moment. From FIG. 9 it is seen that the righting moment can be affected by both the total torque $T_B$ due to the wind pressure and or the sum of the torque $T_D$ and $T_s$ as above described and the torque $T_M$ due to the weight of the kite about the supporting point of the kite. As above described, the resultant force F due to the wind pressure can not be greater than the resilience $F_k$. It is recalled that the absolute values of the force F and resilience $F_k$ are at most equal in magnitude and opposite in sense to each other. In this example, the resilience $F_k$ provides the torque $T_B$ in the clockwise direction about the supporting point on the flying object while the weight $M_g$ of the flying object provides the torque $T_M$ in the counterclockwise direction about the same point. Therefore the flying object can have a righting moment as long as the inequality $T_B>T_M$ is held.

From FIG. 9 it is seen that the $T_B$ and $T_M$ are expressed by $T_B=F_kA_z$ and $T_M=M_gB_x\cos\epsilon\sin\theta$ respectively. Accordingly there is obtained $$F_kA_z>M_gB_x\cos\theta\cos\epsilon$$

The lefthand side of the above inequality has a maximum value at $\epsilon\approx 23$ degrees. That maximum value is equal to $0.44\lambda A_z$ as will be obtained from the equation for $F_k$ as above described. For the maximum value of $F_kA_z$ the righthand side of the inequality or the $T_B$ has a value approximately equal to $M_gB_x\,0.916\sin\theta$.

Since it is required only to consider an attack angle of a flying object ranging from 0 to $\pi/2$ radians, $\sin\theta$ may have a value ranging from 0 to 1. Thus, the $T_B$ has a maximum value of $0.916\,M_gB_x$ for the maximum value of $F_kA_z$. Consequently one obtains $$0.44\,\lambda\,A_z > 0.916\,M_gB_x$$

or $$\frac{\lambda}{M_g} > \frac{0.916\,B_x}{0.44\,A_z} \approx 2\,\frac{B_x}{A_z}$$

This inequality approximately describes the relationship between the resilience of the resilient member and the weight of the flying object. Assuming that a ratio of $B_x$ to $A_z$ is on the order of 2.5 which is generally applicable to flying objects taught by the principles of the present invention, the resilient member should have a spring constant λ greater than five times the weight of the flying object divided by the distance b.

As an example, a flying object including a resilient member having a spring constant λ smaller than five times the weight $M_g$ divided by distance b thereof has the force relationship $T_{B(mas)} < T_M$. More specifically, if the flying object maintained stably stationary in the air is subject to any disturbance then it is initiated to be moved so as to decrease in attack angle. Eventually the flying object stands upright until the attack angle thereof will reach the negative domain thereof. As a result, the flying object is disabled to be whirled up by the wind resulting in its fall.

In order that flying objects can be maintained to stably fly in the air while they are subject to any disturbance due to a wind, it is required to use the resilient member having a spring constant exceeding five times the weight divided by the distance b thereof.

In summary, the use of a resilient member having a spring constant greater than five times a weight of a flying object divided by the distance b and less than one half a tensile strength of an associated kite string permits the flying object to stably fly in the air without destruction of the flying object and/or the cutting of the kite string due to wind gusts and also the kite remains stable and will not fall.

What we claim is:

1. A kite, consisting essentially of a wind-bearing surface having a pair of opposite articulate planar sections meeting at a common edge and relatively movable thereabout to change the spacing between said planar surface sections in response to wind bearing against said planar surface sections, said planar surface sections comprising a sheet-like member for bearing wind in flight, and a pair of rigid symmetrical triangular frames, having a common side defining the central axis of the kite, symmetrical about the common side and having said sheet-like member mounted thereon for maintaining said sheet-like member planar while subject to wind pressure in flight; a line attached at a point along said common edge for restraining the kite when it is in flight; and an elastic spacer spanning between said planar surface sections for setting the spacing therebetween, wherein said elastic spacer consists essentially of a single elongate elastic element having a pair of opposite ends each attached to a respective one of said triangular frames and has a spring constant such that the product of said spring constant and a distance from the point of attachment of said line to a point of attachment of said elastic spacer to one of said triangular frames is greater than five times the weight of the kite, and said elastic spacer is shaped embowed away from said triangular frames when it is in an unstressed condition corresponding to no wind pressure being applied to said pair of planar sections.

2. A kite according to claim 1, wherein the tensile strength of said line is greater than about one half the product of said spring constant and said distance from the point of attachment of said line to a point of attachment of said elastic spacer to one of said triangular frames.

* * * * *